US009670043B2

(12) United States Patent
Blanchard et al.

(10) Patent No.: US 9,670,043 B2
(45) Date of Patent: Jun. 6, 2017

(54) LEVER CORKSCREW WITH REMOVABLE WRAPPER CUTTER

(71) Applicant: Helen of Troy Limited, Belleville, St. Michael (BB)

(72) Inventors: Russell Lewis Ernest Blanchard, New York, NY (US); Morris Elijah Worden, IV, New York, NY (US); Dario Alejandro Narvaez Lopez, North Bergen, NJ (US); Anthony John Baxter, Upper Montclair, NJ (US); Carly Brush, Weston, MA (US); Mackenzie Mor, New York, NY (US)

(73) Assignee: Helen of Troy Limited, Belleville, St. Michael (BB)

( * ) Notice: Subject to any disclaimer, the term of this patent is extended or adjusted under 35 U.S.C. 154(b) by 366 days.

(21) Appl. No.: 14/471,532

(22) Filed: Aug. 28, 2014

(65) Prior Publication Data

US 2016/0060086 A1 Mar. 3, 2016

(51) Int. Cl.
*B67B 7/04* (2006.01)

(52) U.S. Cl.
CPC .... *B67B 7/0441* (2013.01); *B67B 2007/0458* (2013.01)

(58) Field of Classification Search
CPC ..... B67B 7/0441; B67B 1/045; B67B 2007/0458; B67B 7/04; B67B 7/16; B67B 7/44
See application file for complete search history.

(56) References Cited

U.S. PATENT DOCUMENTS

| | | | | |
|---|---|---|---|---|
| 776,152 | A * | 11/1904 | Strohacker | B67B 7/18 81/3.33 |
| 3,722,327 | A | 3/1973 | Strassel | |
| 6,151,992 | A | 11/2000 | Larimer | |
| 6,196,086 | B1 | 3/2001 | Gort-Barten | |
| D445,008 | S | 7/2001 | Andina et al. | |
| 6,257,092 | B1 | 7/2001 | Gort-Barten | |
| D477,757 | S | 7/2003 | Yu | |
| 6,622,330 | B2 | 9/2003 | Puig | |
| D505,848 | S | 6/2005 | Lee | |
| 7,024,715 | B2 * | 4/2006 | Hefti | B67B 7/0447 7/156 |

(Continued)

FOREIGN PATENT DOCUMENTS

DE 4326582 2/1995

OTHER PUBLICATIONS

Stress Less Automatic Lever Corkscrew with Foil Cutter; http://www.shoptrudeau.com/Stress-Less-Automatic-Lever-Corkscrew-w-Foil-Cutte-p/0979009.htm printed Jun. 3, 2014.

*Primary Examiner* — Robert Scruggs
(74) *Attorney, Agent, or Firm* — Rankin, Hill & Clark LLP

(57) ABSTRACT

A corkscrew includes a main body, a grip moveably connected with the main body, a lever moveably connected with the main body, a worm operably connected with the lever, and a wrapper cutter detachably connected with the main body. The grip and the main body define a space configured to receive a neck of an associated bottle, such as a wine bottle. The worm connects with the lever such that movement of the lever results in movement of the worm. The wrapper cutter includes a cutting element for cutting a wrapper surrounding the neck of the associated bottle.

19 Claims, 6 Drawing Sheets

(56) References Cited

U.S. PATENT DOCUMENTS

| | | | | |
|---|---|---|---|---|
| 7,069,813 | B2 | 7/2006 | Cheung | |
| 7,069,825 | B2 | 7/2006 | Cheung | |
| 7,370,556 | B2 | 5/2008 | Sun | |
| 7,395,737 | B2 | 7/2008 | Zhou | |
| 7,398,709 | B2 | 7/2008 | Vitrac et al. | |
| 7,481,134 | B2 * | 1/2009 | Goldstein | B67B 7/0447 7/155 |
| 2012/0152081 | A1 | 6/2012 | Agarwal et al. | |

* cited by examiner

LEVER CORKSCREW WITH REMOVABLE WRAPPER CUTTER

BACKGROUND

Conventional wine bottles are closed with a cork that is positioned within an opening at the top of the wine bottle. Traditional corks are made from the outer bark of the cork oak. Synthetic corks are also known, which can be made from plastic, rubber or other synthetic materials. The top of the wine bottle is often covered with a metal foil wrapper. As such, opening a conventional wine bottle often requires a two-step process: removal of the wrapper and removal of the cork after the removal of the wrapper.

Two separate tools are often used to open a conventional wine bottle. A knife or a tool including a blade is used to cut the wrapper to facilitate removal of the wrapper from the wine bottle. A second tool, usually including a spiral-shaped worm and often known as a corkscrew, is used to extract the cork from the bottle opening. Oftentimes these tools are separate from one another and are stored separately from one another.

SUMMARY

In view of the foregoing, a new corkscrew is provided. Such a corkscrew includes a main body, a grip moveably connected with the main body, a lever moveably connected with the main body, a worm operably connected with the lever, and a wrapper cutter detachably connected with the main body. The grip and the main body define a space configured to receive a neck of an associated bottle, such as a wine bottle. The worm connects with the lever such that movement of the lever results in movement of the worm. The wrapper cutter includes a cutting element for cutting a wrapper surrounding the neck of the associated bottle. The space between the grip and the main body can receive the neck of the associated bottle when the wrapper cutter is connected with the main body.

The main body can include a recess, and the wrapper cutter can be received in the recess when connected with the main body. The corkscrew can further include a catch in the recess. The wrapper cutter can include a catch element that cooperates with the catch for retaining the wrapper cutter in the recess. There can be a first catch positioned near a first end of the recess and a second catch positioned near a second end of the recess. There can also be a first catch element positioned near a first end of the wrapper cutter and second catch element positioned near a second end of the wrapper cutter.

The aforementioned wrapper cutter can also be U-shaped. The wrapper cutter can include a depression configured to receive a finger or thumb of an operator to facilitate removal of the wrapper cutter from the main body. There can be a first depression positioned near a first end of the wrapper cutter and a second depression positioned near a second end of the wrapper cutter. The wrapper cutter can also include an upper surface, a lower surface, an inner surface and an outer surface. The cutting element can extend inwardly from the inner surface. The inner surface may not be visible when the wrapper cutter is received in the recess and connected with the main body. At least a majority of each of the upper surface and the lower surface may not be visible when the wrapper cutter is received in the recess and connected with the main body.

The worm mentioned above can move along a first axis. The wrapper cutter mentioned above is removable from the main body by pulling the wrapper cutter in a removal direction that is nearer to perpendicular with the first axis as compared to parallel or coaxial with the first axis.

The corkscrew can include a first block connected with the worm such that movement of the first block results in movement of the worm. The grip can pivot about a first pivot axis with respect to the main body. The lever can pivot about a second pivot axis and a third pivot axis with respect to the main body. The lever is connected with the first block and can pivot about a fourth pivot axis with respect to the first block. The first pivot axis can be parallel to the second, third and fourth pivot axes.

The lever can include a handle section that extends in a rearward direction from the main body. The wrapper cutter mentioned above can be removed by pulling in a generally forward direction, which is generally opposite the rearward direction.

The main body can include a head and a lower wall extending down from the head. The space configured to receive the neck of the associated wine bottle can be positioned between an inner surface of the lower wall and an inner surface of the grip. The head can include a recess and the wrapper cutter can be received in the recess when connected with the main body. The corkscrew can further include a catch formed in the recess in the head and the wrapper cutter includes a catch element that cooperates with the catch for retaining the wrapper cutter in the recess. The head can include a further recess and the cutting element of the wrapper cutter can be received in the further recess when connected with the main body.

DETAILED DESCRIPTION

Figure 1:
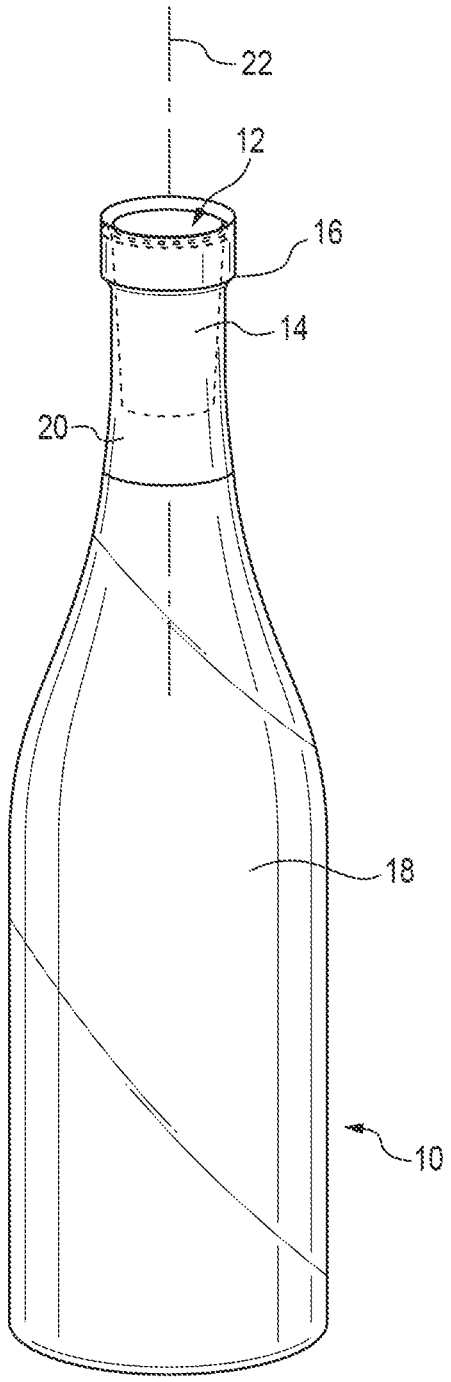
FIG. 1 is a perspective view of a conventional wine bottle with a wrapper and a cork.

FIG. 1 illustrates a conventional wine bottle 10 having an opening 12 closed by a cork 14 (shown in phantom). The cork 14 can be the traditional cork or a synthetic cork, which have been described above. The opening 12 is positioned at the top of the bottle 10. A top portion, hereinafter referred to as the neck 16, of the bottle 10 may be elongate and generally cylindrical and extend upwardly from a main body 18 of the bottle 10. With the opening 12 closed by the cork 14, the neck 16 can be covered with a wrapper 20, which can be made from foil. The bottle 10 can be centered with respect to a central axis 22, which is generally vertically oriented when the bottle is in a typical upright configuration.

Figure 2:
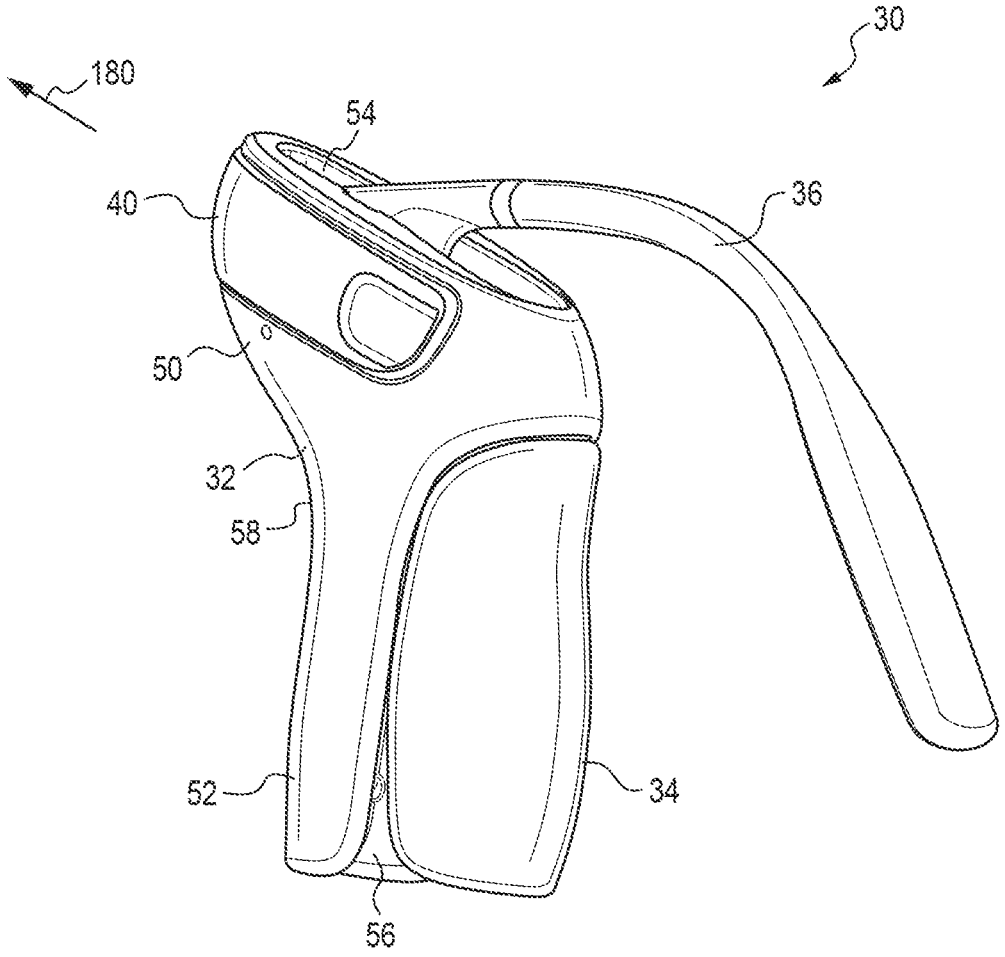
FIG. 2 is a perspective view of a corkscrew having a wrapper cutter connected with a main body of the corkscrew.

FIG. 2 illustrates a corkscrew 30 that can be used to extract the cork 14 from the bottle 10 and also to cut the wrapper 20 from around the neck 16 of the bottle. The corkscrew 30 includes a main body 32, a grip 34 moveably connected with the main body, a lever 36 moveably connected with the main body 32, a worm 38 (see FIG. 6)

operably connected with the lever 36, and a wrapper cutter 40 detachably connected with the main body 32. The worm 38 in combination with the lever 36 can be moved to extract the cork 14 from the bottle 10. The wrapper cutter 40 can be detached from the main body 32 and used to cut the wrapper 20 on the bottle 10 to facilitate removal of at least a portion of the wrapper from the bottle.

With continued reference to the embodiment illustrated in FIG. 2, the main body 32 includes a head 50 and a lower wall 52 extending downwardly from the head. The head 50 of the main body 32 makes up an upper section of the main body and is disposed above the lower wall 52 when the corkscrew 30 is in use to remove the cork 14 from the bottle 10. The main body 32 also includes an upper opening 54 provided in the head 50. The lever 36 extends into the opening 54 to connect with the worm 38 in a manner that will be described in more detail below. The lower wall 52 of the main body 32 includes an inner surface 56 that is curved so as to accommodate the neck 16 of the bottle 10. The main body 32 also includes an outer surface 58. The outer surface 58 of the main body 32 in the region of the lower wall 52 is curved so as to be gripped by the hand of an operator of the corkscrew 30. With respect to FIG. 3, the main body 32 also includes a recess 60. In the illustrated embodiment, the recess 60 is formed in the head 50 of the main body 32 and extends inwardly from the outer surface 58 of the main body. As seen when comparing FIG. 2 to FIG. 3, the wrapper cutter 40 is received in the recess 60 when connected with the main body 32.

Figure 3:
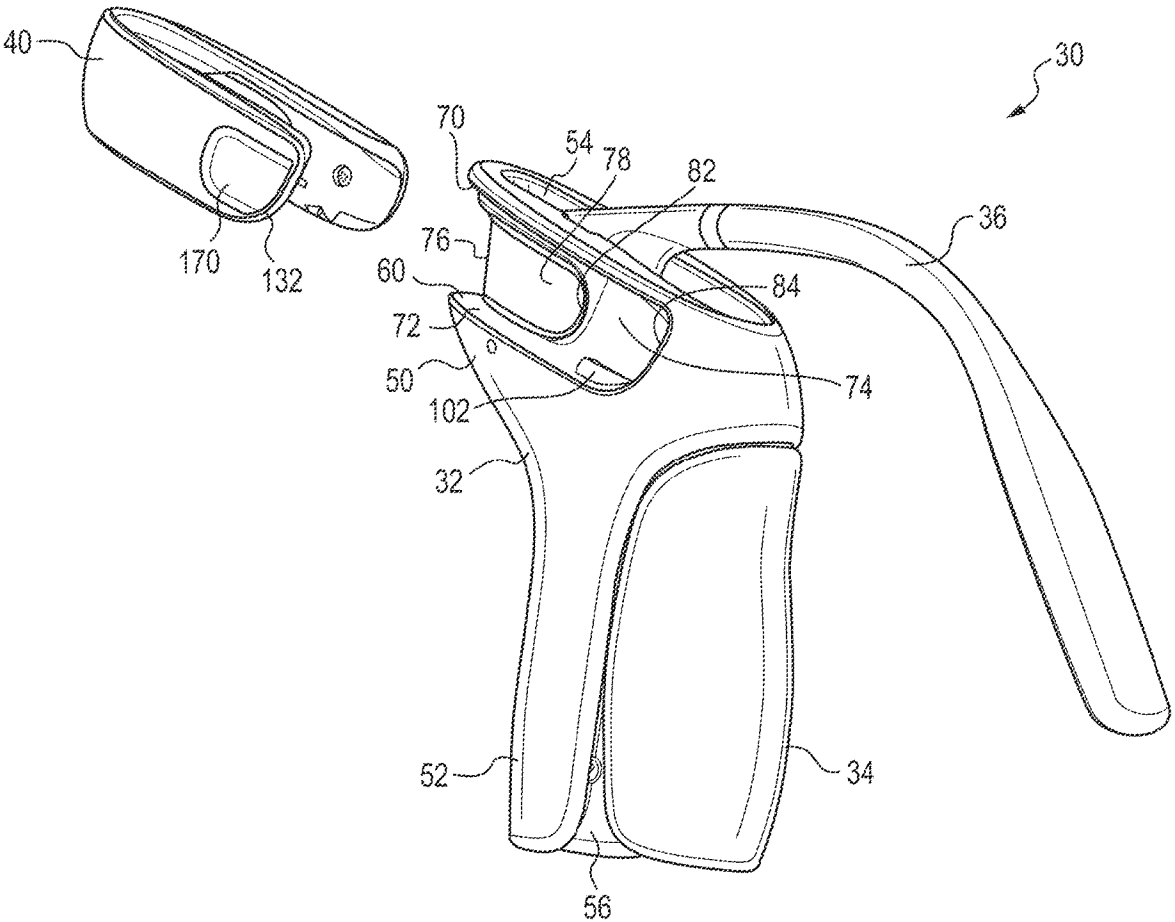
FIG. 3 is similar perspective view to FIG. 2; however, the wrapper cutter has been removed from the main body.
Figure 4:
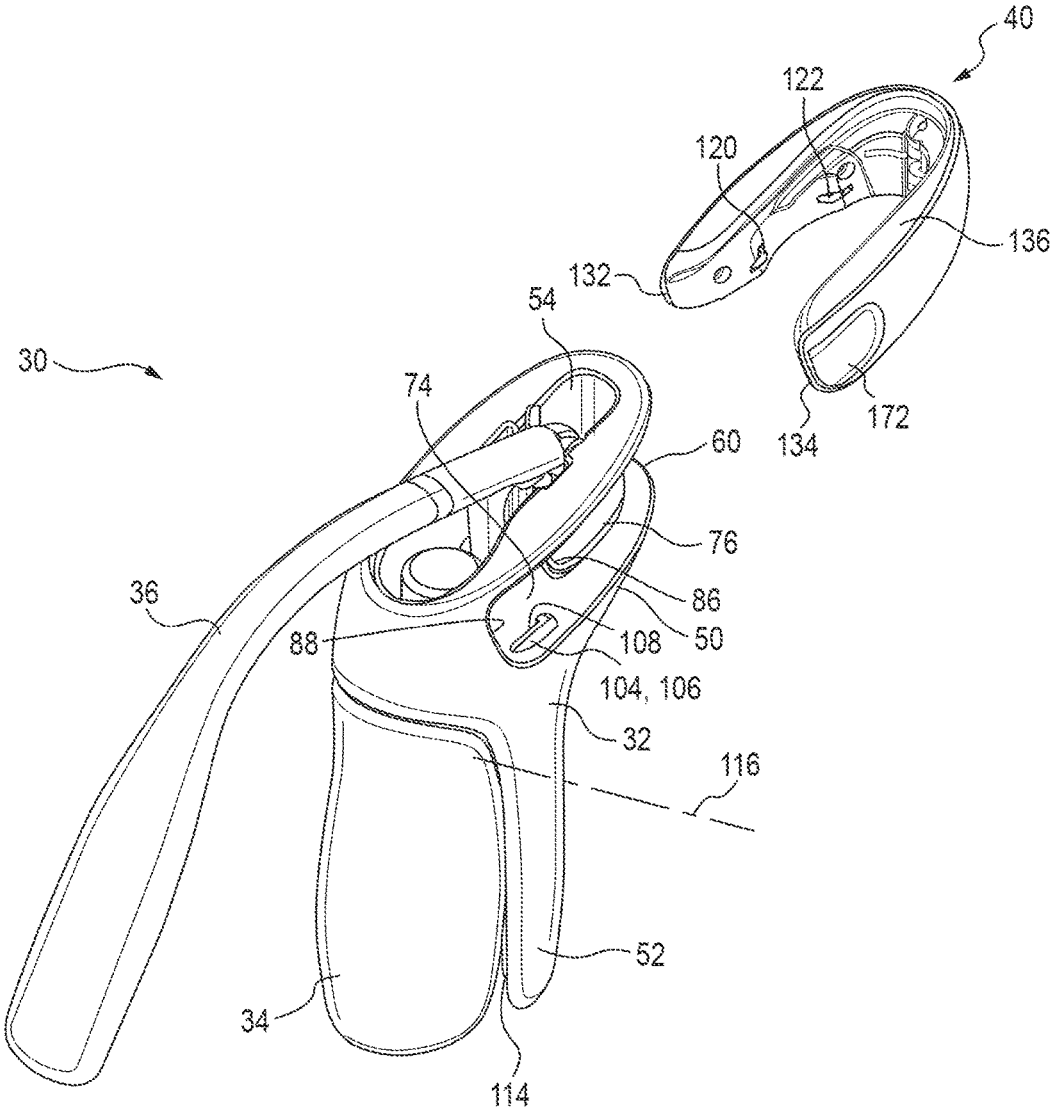
FIG. 4 is another perspective view from an opposite side of the corkscrew as that shown in FIG. 3 with the wrapper cutter removed from the main body of the corkscrew.

The recess 60 is generally U-shaped to accommodate the wrapper cutter 40. The recess 60 is defined by an upper surface 70, a lower surface 72 and a first base surface 74. The upper surface 70 and the lower surface 72 are angled, but are more horizontally than vertically oriented when the corkscrew is oriented to fit onto the neck 16 of the bottle 10. Both the upper surface 70 and the lower surface 72 extend inwardly from the outer surface 58 of the main body 32 toward the first base surface 74. The first base surface 74 is generally parallel with the outer surface 58 so as to follow the contour of the outer surface. The main body 32 includes a further recess 76 formed in the recess 60. The further recess 76 is also U-shaped and extends further inwardly from the first base surface 74 so as to define a second base surface 78 that is offset inwardly from the first base surface. As seen in FIG. 3, the further recess 76 includes a first end 82 that is spaced from a first end 84 of the recess 60. With reference to FIG. 4, the further recess 76 also includes a second end 86 that is spaced from a second end 88 of the recess 60.

A catch (two catches 102, 104 are shown) is formed in the recess 60 and cooperates with the wrapper cutter 40 to retain the wrapper cutter within the recess 60. In the illustrated embodiment, the first catch 102 is positioned near the first end 84 of the recess 60 and the second catch 104 is positioned near the second end 88 of the recess. Each catch 102, 104 is identical in configuration. As such, the second catch 104 will be described with particularity. The second catch includes an L-shaped wall 106 that defines an opening 108 between the L-shaped wall and the first base surface 74 of the recess 60.

As mentioned above, the grip 34 is moveably connected with the main body 32. The grip 34 and the main body 32 define a space configured to receive the neck 16 of the bottle 10. The grip 34 includes an inner surface 114 (FIG. 4). Similar to the inner surface 56 of the lower wall 52, the inner surface 114 of the grip 34 is curved to accommodate the neck 16 of the bottle 10. The space that is configured to receive the neck 16 of the bottle 10 is positioned between the inner surface 56 of the lower wall 52 and the inner surface 114 of the grip 34. The space between the grip 34 and the main body 32 can receive the neck of the associated bottle when the wrapper cutter 40 is connected with the main body. The grip 34 is able to pivot with respect to the main body 32. The grip 34 pivots about a first pivot axis 116 with respect to the main body 32.

As discussed above, the wrapper cutter 40 is detachably connected with the main body 32. As more clearly seen in FIG. 4, the wrapper cutter 40 includes cutting elements 120, 122, which in the illustrated embodiment are cutting wheels, for cutting the foil wrapper 20 surrounding the neck 16 of the bottle 10. Other cutting elements, such as fixed blades, could be used as cutting elements.

Figure 5:
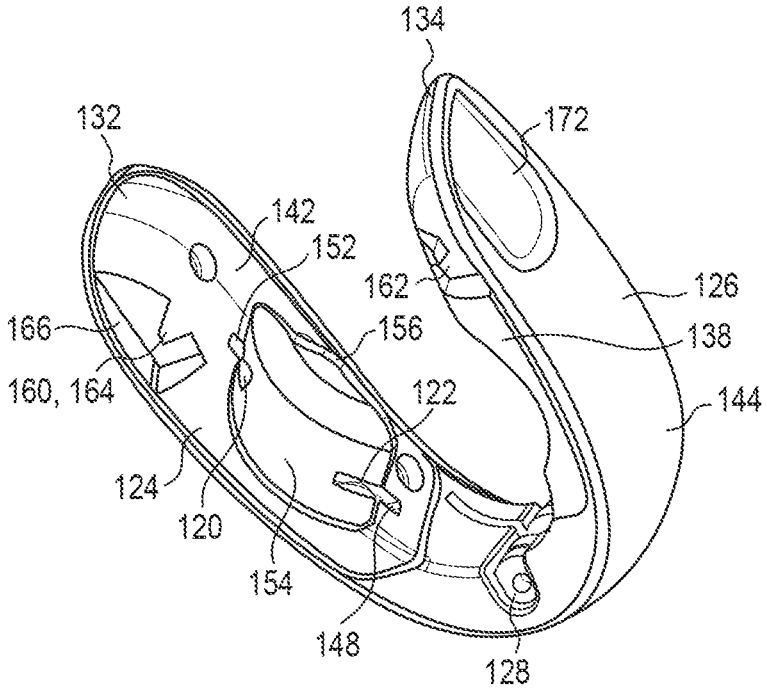
FIG. 5 is a lower perspective view of the wrapper cutter depicted in FIGS. 2-4.

The wrapper cutter 40 in the illustrated embodiment can be made from two members, e.g., a first member 124 and a second member 126, connected by a hinge section 128. The wrapper cutter 40 has an overall U-shape configuration and includes a first end 132 and a second end 134. The wrapper cutter 40 includes an upper surface 136, a lower surface 138, an inner surface 142, and an outer surface 144. There is a hollow space between the inner surface 142 and the outer surface 144 where the cutting elements 120, 122 are mounted. Cutting elements similar to those shown in FIGS. 4 and 5 are provided along the second member 126 and extend inwardly beyond the inner surface 142. The configuration of the wrapper cutter 40 along the inner surface 142 of the second member 126 is a mirror configuration of that of the first member 124. Accordingly, only the configuration along the first member will be described with particularity. A forward opening 148, which is nearer a closed end of the wrapper cutter 40, and a rear opening 152, which is nearer to the first end 132, are provided in the inner surface 142. The first cutting element 120 extends through the rear opening 152. The second cutting element 122 extends through the forward opening 148. A curved recess 154 is provided in the inner surface 142. The curved recess 154 follows the radius at the top of the wine bottle 10 and each of the cutting elements 120 and 122 extend into the curved recess 154 so as to engage the wrapper 20. When the wrapper cutter 40 is received in the recess 60 and connected with the main body 32, the cutting elements 120, 122 are received in the further recess 76. A horizontal shelf 156 is provided above the curved recess 154. The horizontal shelf 156 can provide a locating feature so as to engage the top of the bottle 10 to properly align the cutting elements 120 and 122 to engage the wrapper 20.

The wrapper cutter 40 includes a catch element (two catch elements 160, 162 are in the illustrated embodiment) that cooperates with the catch (two catches 102, 104 are in the illustrated embodiment) for retaining the wrapper cutter 40 in the recess 60. In the illustrated embodiment, the first catch element 160 is positioned near the first end 132 of the wrapper cutter 40 and the second catch element 162 is positioned near the second end 134 of the wrapper cutter 40. In the illustrated embodiment, the catch elements 160 and 162 are mirror images of one another. As such, only the first catch element 160 will be described with particularity. The first catch element 160 includes a bump 164 that extends into a recess 166 that extends upwardly from the lower surface 138 of the wrapper cutter 40. The recess 166 is formed at the first end 132. The bump 164 is received in the respective opening (a similar opening 108 is visible in FIG. 4) of the first catch 102 formed in the recess 60 to connect the wrapper cutter 40 with the main body 32.

The wrapper cutter 40 also includes a depression (a first depression 170 is visible in FIG. 3 and a second depression 172 is visible in FIG. 5) configured to receive a finger or thumb of an operator to facilitate removal of the wrapper cutter 40 from the main body 32. The first depression 170 is positioned near the first end 132 of the wrapper cutter 40. The second depression 172 is positioned near the second end 134 of the wrapper cutter 40. Each of the depressions 170 extends inwardly from the outer surface 144 of the wrapper cutter. With reference to FIG. 2, the inner surface 142 of the wrapper cutter 40 is not visible when the wrapper cutter is received in the recess 60 and connected with the main body 32. At least a majority of each of the upper surface 136 and the lower surface 138 is also not visible when the wrapper cutter 40 is received in the recess 60 and connected with the main body 32. To remove the wrapper cutter 40 from the main body 32, an operator can place his thumb in one of the depressions 172 and a finger in the other depression 170 and pull the wrapper cutter in a removal direction (see arrow 180). The removal direction as indicated by arrow 180 is nearer to perpendicular with a worm axis 182 (FIG. 6), which is an axis in which the worm 38 moves, as compared to parallel or coaxial with the worm axis. The removal direction as indicated by arrow 180 can also be referred to as a generally forward direction. The lever 36 extends from the main body 32 in a generally rearward direction. The wrapper cutter 40 is removed by pulling in the generally forward direction, as indicated by arrow 180, which is generally opposite the rearward direction.

Figure 6:
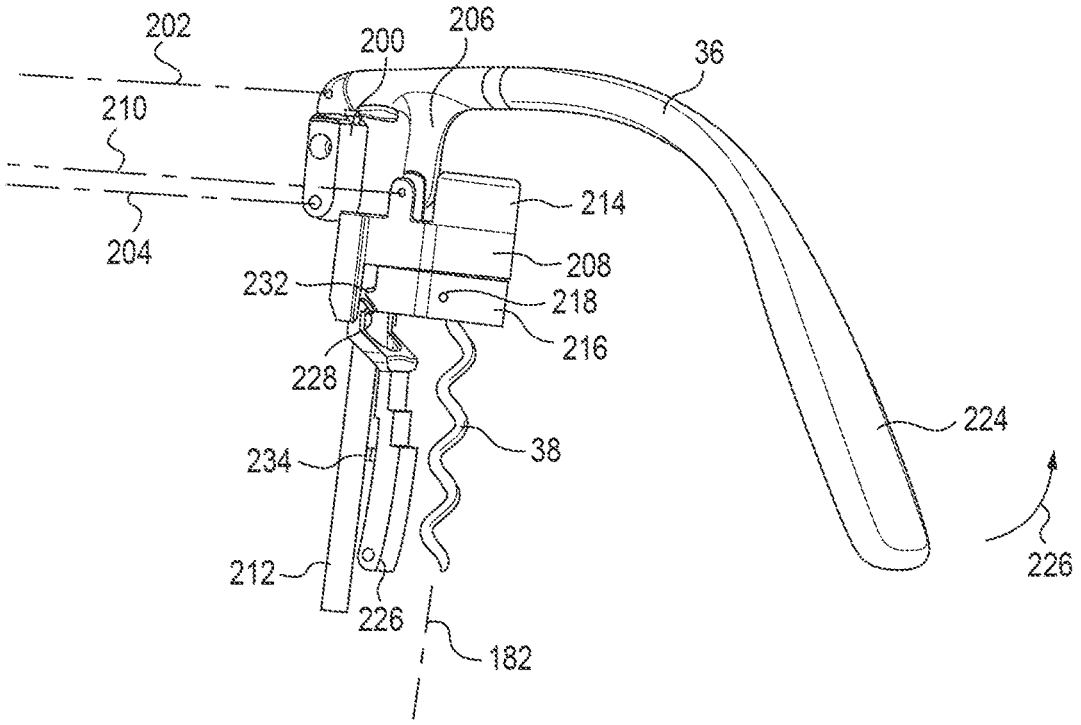
FIG. 6 depicts a cork extraction mechanism for the corkscrew depicted in FIGS. 2-4.

FIG. 6 depicts the mechanism for removing the cork 14 from the opening 12 in the bottle 10. The lever 36 is moveably connected to the main body 32 through a connecting link 200. The lever 36 is pivotally connected with the connecting link 200 so as to pivot about a second pivot axis 202 with respect to the connecting link 200. The connecting link 200 is pivotally connected with the main body 32 so as to pivot about a third pivot axis 204. An arm 206 extends downwardly from the lever 36. The arm 206 pivotally connects with a first block 208 so as to pivot about a fourth pivot axis 210. The first block 208 is connected with the lever 36 so as to be raised and lowered with the lever as the lever 36 is pivoted. The first block 208 connects with a guide rod 212, which is slidably connected with the main body. The worm 38 extends through the first block 208 and connects with a cap 214, which is connected with the first block 208.

A second block 216 is positioned beneath the first block 208 and receives a worm guide 218. The worm guide 218 is configured such that when the worm 38 moves relative to the worm guide 218, the worm 38 rotates about the worm axis 182. The guide rod 212 also passes through an opening in the second block 216 and can be received in a channel (not shown) formed in the main body 32 in the area near the lower wall 52.

In operation, prior to insertion of the neck 16 of the bottle 10 into the space between the lower wall 52 and the grip 34, the lever 36, which includes a handle portion 224, is raised in the direction of arrow 226 from the orientation shown in FIG. 6. This movement results in movement of the first block 208, the guide rod 212, and the worm 38 upward so that the worm is no longer in the space configured to receive the neck 16 of the bottle 10. A trigger 228 which includes a hook 230 extends into the space between the lower wall 52 and the grip 34. When there is no force acting on the trigger 228, e.g., the neck 16 is not in the space between the lower wall 52 and the grip 34 and pressing against the trigger, the trigger is engaged with a hook element 232 on the second block 216. This retains the second block 216 and the worm guide 218 in the location shown in FIG. 6 even though the lever 36 has been raised.

The neck 16 of the bottle 10 is then inserted into the space between the lower wall 52 and the grip 34. The neck 16 engages the trigger 228 and pivots the trigger such that the hook 230 disengages the second block 216. The lever 36 is then pressed downwardly, which causes the worm 38 to thread through the worm guide 218 and into the cork 14. With the trigger 228 released from the second block 216, as the lever 36 is then raised, the second block 216 moves together with the first block 206 upwardly and away from the neck 16 of the bottle 10. The worm guide 218 engages the worm 38 and prevents rotation. This draws the cork 14 from the bottle 10 and the bottle 10 can then be removed from the space defined between the lower wall 52 and the grip 34. Once the bottle is removed from the space defined between the lower wall 52 and the grip 34, the trigger 228 moves back to its engaging position by means of a spring 234. The lever 36 is then moved downwardly until the hook 230 engages the hook element 232 on the second block 216. Movement of the lever 36 back upwardly in the direction of arrow 226 threads the worm 38 through the worm guide 218 and, in turn, out of the cork 14 thereby removing the cork from the worm.

A corkscrew having a removable wrapper cutter has been described above with particularity. Modifications and alterations will occur to those upon reading and understanding the preceding detailed description. The invention, however, is not limited only to the embodiments described above. Instead, the invention is broadly defined by the appended claims and the equivalents thereof.

The invention claimed is:

1. A corkscrew comprising:

a main body;

a grip movably connected with the main body, wherein the grip and the main body define a space configured to receive a neck of an associated bottle;

a lever movably connected with the main body;

a worm operably connected with the lever such that movement of the lever results in movement of the worm; and a wrapper cutter detachably connected with the main body and including a cutting element for cutting a wrapper surrounding the neck of the associated bottle, wherein the space between the grip and the main body can receive the neck of the associated bottle when the wrapper cutter is connected with the main body, wherein the wrapper cutter has a U-shaped configuration with an opening that faces the lever when connected with the main body, opposing first and second members of the wrapper cutter are releasably connected to opposing exterior sides of the main body.

2. The corkscrew of claim 1, wherein the main body includes a recess and the wrapper cutter is received in the recess when connected with the main body.

3. The corkscrew of claim 2, further comprising a catch in the recess and the wrapper cutter includes a catch element that cooperates with the catch for retaining the wrapper cutter in the recess.

4. The corkscrew of claim 3, wherein the catch includes a first catch positioned near a first end of the recess and a second catch positioned near a second end of the recess, and the catch element includes a first catch element positioned near a first end of the wrapper cutter and a second catch element positioned near a second end of the wrapper cutter.

5. The corkscrew of claim 1, wherein the wrapper cutter includes a depression configured to receive a finger or a thumb of an operator to facilitate removal of the wrapper cutter from the main body.

6. The corkscrew of claim 5, wherein the depression includes a first depression positioned near a first end of the wrapper cutter and a second depression positioned near a second end of the wrapper cutter.

7. The corkscrew of claim 1, wherein the wrapper cutter includes an upper surface, a lower surface, an inner surface and an outer surface, wherein the cutting element extends inwardly from the inner surface, wherein the inner surface is not visible when the wrapper cutter is received in the recess and connected with the main body and at least a majority of each of the upper surface and the lower surface is not visible when the wrapper cutter is received in the recess and connected with the main body.

8. The corkscrew of claim 1, wherein the worm is movable along a first axis and the wrapper cutter is removable from the main body by pulling the wrapper cutter in a removal direction that is nearer to perpendicular with the first axis as compared to parallel or coaxial with the first axis.

9. The corkscrew of claim 1, further comprising a first block connected with the worm such that movement of the first block results in movement of the worm, wherein the grip pivots about a first pivot axis with respect to the main body, wherein the lever pivots about a second pivot axis and a third pivot axis with respect to the main body, wherein the lever is connected with the first block and pivots about a fourth pivot axis with respect to the first block, wherein the first axis is parallel to the second, third and fourth pivot axes.

10. The corkscrew of claim 1, wherein the lever includes a handle section that extends in a rearward direction from the main body.

11. The corkscrew of claim 10, wherein the wrapper cutter is removed by pulling in a generally forward direction, which is generally opposite the rearward direction.

12. The corkscrew of claim 11, wherein the main body includes a head and a lower wall extending down from the head, wherein the space configured to receive the neck of the associated wine bottle is positioned between an inner surface of the lower wall and an inner surface of the grip.

13. The corkscrew of claim 12, wherein the head includes a recess and the wrapper cutter is received in the recess when connected with the main body.

14. The corkscrew of claim 13, further comprising a catch formed in the recess and the wrapper cutter includes a catch element that cooperates with the catch for retaining the wrapper cutter in the recess.

15. The corkscrew of claim 14, wherein the head includes a further recess and the cutting element of the wrapper cutter is received in the further recess when connected with the main body.

16. The corkscrew of claim 15, wherein the wrapper cutter includes an upper surface, a lower surface, an inner surface and an outer surface, wherein the cutting element extends inwardly from the inner surface, wherein the inner surface is not visible when the wrapper cutter is received in the recess formed in the head and connected with the main body and at least a majority of each of the upper surface and the lower surface is not visible when the wrapper cutter is received in the recess formed in the head and connected with the main body.

17. The corkscrew of claim 12, wherein the head includes a recess and the wrapper cutter is received in the recess when connected with the main body.

18. The corkscrew of claim 1, wherein the lever includes a connection portion which connects the lever to the main body and a handle portion, the connecting portion is positioned within the opening of the wrapper cutter when the wrapper cutter is connected with the main body.

19. A corkscrew comprising:

a main body including a head and a lower wall extending down from the head;

a grip movably connected with the main body, wherein the grip and the lower wall define a space configured to receive a neck of an associated bottle;

a lever movably connected with the main body;

a worm operably connected with the lever such that movement of the lever results in movement of the worm; and a wrapper cutter detachably connected with the head of the main body and including a cutting element for cutting a wrapper surrounding the neck of the associated bottle, wherein the wrapper cutter is U-shaped and includes an upper surface, a lower surface, an inner surface and an outer surface, wherein a curved recess is provided on the inner surface to receive the neck of the associated bottle and the cutting element extends inwardly from the inner surface and into the curved recess.

* * * * *